US006807890B1

(12) United States Patent
Fuqua

(10) Patent No.: US 6,807,890 B1
(45) Date of Patent: Oct. 26, 2004

(54) COLLAPSIBLE BALLISTIC SHIELD

(75) Inventor: Charles Fuqua, Woodbridge, VA (US)

(73) Assignee: Patriot3, Inc., Woodbridge, VA (US)

( * ) Notice: Subject to any disclaimer, the term of this patent is extended or adjusted under 35 U.S.C. 154(b) by 0 days.

(21) Appl. No.: 10/270,502

(22) Filed: Oct. 16, 2002

Related U.S. Application Data

(60) Provisional application No. 60/379,771, filed on May 14, 2002, now abandoned, and provisional application No. 60/379,390, filed on May 13, 2002, now abandoned.

(51) Int. Cl.[7] ..... F41H 5/04; F41H 5/08

(52) U.S. Cl. ..... 89/36.02; 89/36.05; 89/36.07

(58) Field of Search ..... 89/36.02, 36.04, 89/36.05, 36.06, 36.07; 2/2.5; 428/911

(56) References Cited

U.S. PATENT DOCUMENTS

| | | | | |
|---|---|---|---|---|
| 2,020,702 A | * | 11/1935 | Russell | |
| 3,745,938 A | | 7/1973 | Hathaway et al. | 109/49.5 |
| 4,412,495 A | * | 11/1983 | Sankar | 109/49.5 |
| 4,782,735 A | | 11/1988 | Mui et al. | 89/36.07 |
| 5,031,733 A | * | 7/1991 | Chang | 2/2.5 |
| 5,293,807 A | * | 3/1994 | Hajdu | 89/36.7 |
| 5,377,577 A | | 1/1995 | Bounkong et al. | 89/36.05 |
| 5,392,686 A | | 2/1995 | Sankar | 89/36.05 |
| 5,614,280 A | * | 3/1997 | Hanna | 428/74 |
| 5,619,007 A | | 4/1997 | Mena et al. | 89/36.09 |
| 5,729,830 A | * | 3/1998 | Luhtala | 2/2.5 |
| 5,829,653 A | * | 11/1998 | Kaiser | 2/2.5 |
| 5,915,528 A | * | 6/1999 | Shmuelov | 2/2.5 |
| 5,939,658 A | * | 8/1999 | Muller | 89/36.04 |
| 6,000,347 A | | 12/1999 | Madden, Jr. | 109/49.5 |
| 6,161,462 A | | 12/2000 | Michaelson | 89/36.01 |

FOREIGN PATENT DOCUMENTS

| | | | | |
|---|---|---|---|---|
| DE | 24 12 568 | * | 9/1975 | 89/36.05 |

* cited by examiner

*Primary Examiner*—Stephen M. Johnson
(74) *Attorney, Agent, or Firm*—Harrity & Snyder LLP

(57) ABSTRACT

A ballistic shield may include a first ballistic plate that includes a ballistic material. A second ballistic plate may also include the ballistic material. The second ballistic plate may be connected to a side of the first ballistic plate so that the first ballistic plate and the second ballistic plate may fold together to substantially overlap. A gap may exist between the first ballistic plate and the second ballistic plate when not folded together. An overlapping ballistic section may include the ballistic material. The overlapping ballistic section may be connected to the first ballistic plate and/or the second ballistic plate so that the overlapping ballistic section covers the gap between the first ballistic plate and the second ballistic plate.

16 Claims, 7 Drawing Sheets

COLLAPSIBLE BALLISTIC SHIELD

RELATED APPLICATIONS

This application claims the benefit of priority under 35 U.S.C. §119(e) of two provisional applications, Ser. Nos. 60/379,390 and 60/379,771, filed May 13, 2002 and May 14, 2002 respectively both now abandoned, the entire contents of which are incorporated herein by reference.

BACKGROUND OF THE INVENTION

1. Field of the Invention

The present invention relates generally to portable shields, and more particularly, to portable ballistic shields.

2. Description of Related Art

Portable shields may be employed for personal protection by law enforcement, military, security, and other personnel. Such portable shields may be typically carried and employed by one person, although the shield may be placed to shelter additional persons behind it.

Ballistic shields are one type of portable shield that are designed to provide additional protection against ballistic projectiles (e.g., bullets fired from a gun). As used herein, a "ballistic" shield or material may be defined as having the property of stopping, or severely retarding the progress of, a projectile such as a bullet. As used herein, "ballistic" may be used interchangeably with "bulletproof," though ballistic material may not be completely impenetrable to all types of bullets and other projectiles under all situations.

Ballistic shields, although portable, are typically of unitary construction (i.e., one continuous piece), necessitating their storage and transportation in a somewhat large space, such as a van. In an emergency situation (e.g., where shots have been fired, hostages taken, etc.), the so-called "first responder" may be the security personnel or other authority that is physically closest to the situation. This first responder may not have access to a needed ballistic shield, because the space requirements of a unitary, personal ballistic shield do not permit everyday transport and storage of such shields by typical first responders.

Therefore, there exists a need for a personal ballistic shield that may be compactly stored and rapidly deployed.

SUMMARY OF THE INVENTION

Apparatuses consistent with the principles of the invention address this and other needs by providing a number of foldably connected ballistic plates that may be extended to form an integral shield. Overlapping ballistic sections may be affixed to cover seams or gaps between adjacent ones of the connected plates.

In accordance with one aspect of the invention as embodied and broadly described herein, a ballistic shield may include a first ballistic plate including a ballistic material. A second ballistic plate may also include the ballistic material. The second ballistic plate may be connected to a side of the first ballistic plate so that the first ballistic plate and the second ballistic plate may fold together to substantially overlap. A gap may exist between the first ballistic plate and the second ballistic plate when not folded together. An overlapping ballistic section may include the ballistic material. The first overlapping ballistic section may be connected to one of the first ballistic plate and the second ballistic plate so that the overlapping ballistic section covers the gap between the first ballistic plate and the second ballistic plate.

In another implementation consistent with principles of the invention, a foldable ballistic shield may include a number of foldably connected ballistic portions. Each of the ballistic portions may include a panel of ballistic material. At least one overlapping ballistic section may be moveably connected to at least one of the number of foldably connected ballistic portions to overlap at least one seam between adjacent ones of the number of foldably connected ballistic portions. Each of the at least one overlapping ballistic sections may include a section of ballistic material.

In a further implementation consistent with principles of the invention, a ballistic shield may include a first ballistic plate including a ballistic material. A second ballistic plate may include the ballistic material and may be connected to a side of the first ballistic plate. The first ballistic plate and the second ballistic plate may fold together to substantially overlap. A fabric may cover the first ballistic plate and the second ballistic plate. The fabric may connect the first ballistic plate and the second ballistic plate.

In still another implementation consistent with principles of the invention, a ballistic shield may include a first ballistic panel including a transparent ballistic section. A second ballistic panel may be rotatably connected to the first ballistic panel. A third ballistic panel may be rotatably connected to the second ballistic panel. A first ballistic section may be moveably connected to one of the first and second ballistic panels to overlap a gap between the first and second ballistic panels. A second ballistic section may be moveably connected to one of the second and third ballistic panels to overlap a gap between the second and third ballistic panels.

BRIEF DESCRIPTION OF THE DRAWINGS

The accompanying drawings, which are incorporated in and constitute a part of this specification, illustrate an embodiment of the invention and, together with the description, explain the invention. In the drawings.

DETAILED DESCRIPTION

The following detailed description of the invention refers to the accompanying drawings. The same reference numbers may be used in different drawings to identify the same or similar elements. Also, the following detailed description does not limit the invention. Instead, the scope of the invention is defined by the appended claims and equivalents.

Exemplary Three Portion Shield

Figure 1:
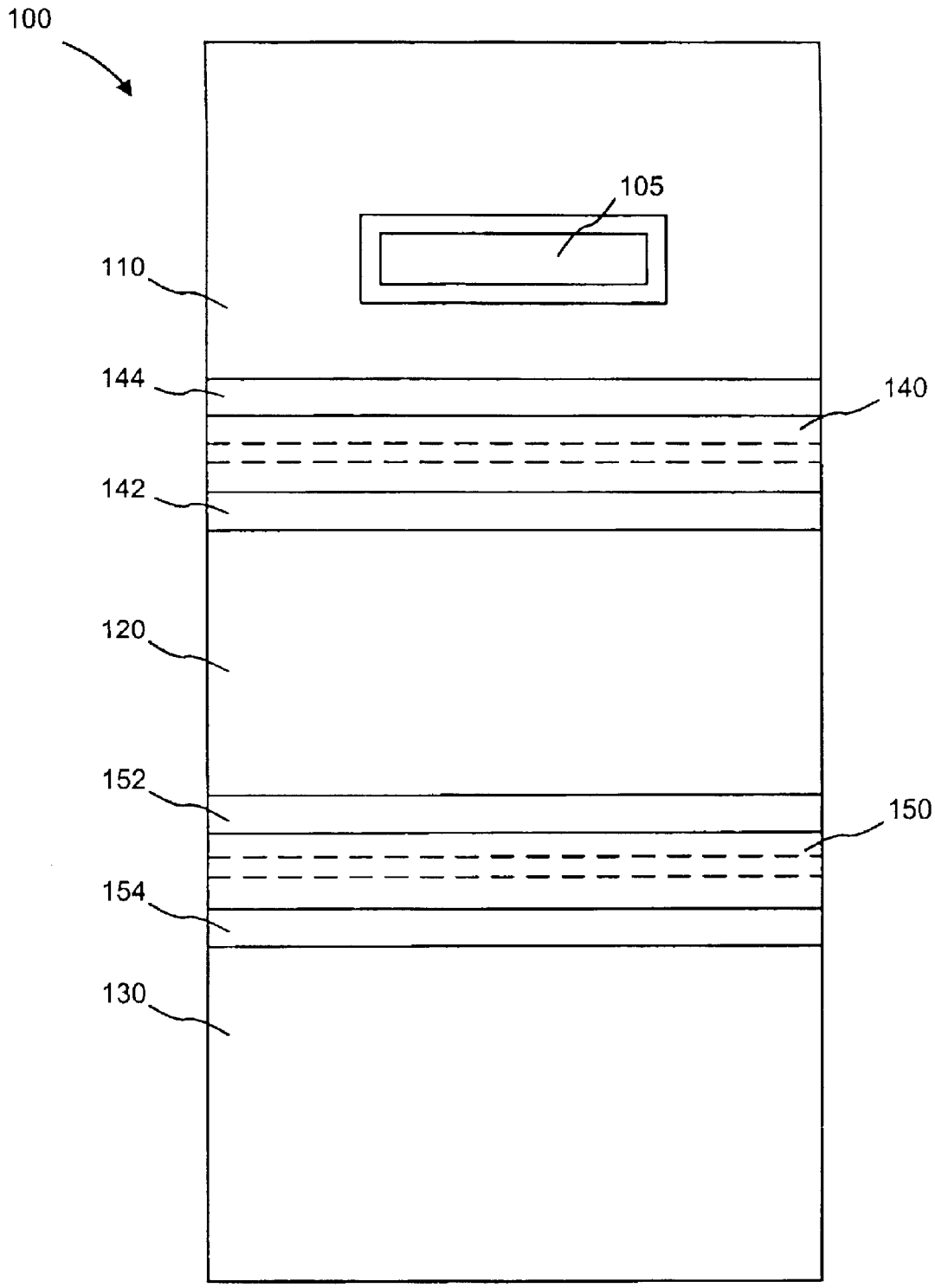
FIG. 1 is a diagram illustrating a front view of an exemplary ballistic shield according to an implementation consistent with the present invention.

FIG. 1 is a diagram illustrating a front view of an exemplary ballistic shield 100 according to an implementation consistent with the present invention. Shield 100 may include a top portion 110, a middle portion 120, a bottom portion 130, a top overlapping panel 140, and a bottom overlapping panel 150. Top portion 110, middle portion 120, and bottom portion 130 may be flexibly connected so that these three portions 110–130 may fold (e.g., in a "Z" manner) to overlap one another. The flexible connections between top portion 110 and middle portion 120, and between middle portion 120 and bottom portion 130, are illustrated as dashed lines in FIG. 1.

Top portion 110 may include a window portion 105. Window portion 105 maybe referred to as a "ballistic view port." The window portion 105 may also be constructed of a ballistic material, such as ballistic polycarbonate or a similar material. The ballistic material in the window portion 105 may be designed to provide a similar level of ballistic protection to ballistic material 310. Window portion 105 may be transparent enough to allow a user of the shield 100 to see through to the other side of the shield.

Top overlapping panel 140 may be flexibly connected to either the top portion 110 or middle portion 120, and bottom overlapping panel 150 may be flexibly connected to either the middle portion 120 or bottom portion 130. For example, top overlapping panel 140 may be flexibly connected to middle portion 120 by a flexible connector 142, and bottom overlapping panel 150 also may be flexibly connected to middle portion 120 by a flexible connector 152. In one implementation consistent with the principles of the invention, flexible connectors 142 and 152 may permanently affix the respective top overlapping panel 140 and bottom overlapping panel 150 to middle portion 120.

Top overlapping panel 140 may be removably connected to top portion 110 by a connecting mechanism 144, and bottom overlapping panel 150 may be removably connected to bottom portion 130 by connecting mechanism 154. The connecting mechanisms 144/154 may include various types of fasteners, such as hook and loop fasteners (e.g., VELCRO® brand fasteners), buttons, snaps, zippers, or similar removable connectors.

Top and bottom overlapping panels 140 and 150 may respectively be oriented to overlap any seams or gaps between the middle portion 120 and the top portion 110 or the bottom portion 130. The seams or gaps are illustrated as dotted lines in FIG. 1, which are covered from the front by top and bottom overlapping panels 140 and 150. These seams or gaps allow the portions 110–130 to fold, but may be an area of ballistic weakness in shield 100 in the absence of overlapping panels 140 and 150.

In one implementation consistent with the principles of the invention, portions 110–130 and overlapping panels 140 and 150 may be connected by a fabric (e.g., CORDURA® brand textured nylon or a similar toughened material, possibly including a ballistic fabric) that serves as an external covering for these portions and panels. The flexible connections between top portion 110, middle portion 120, and bottom portion 130 may be, for example, one or more layers of the fabric that allow folding of the portions 110–130. The flexible connectors 142 and 152 may be implemented by sewing, stitching, or otherwise attaching the fabric covering the respective overlapping panels 140 and 150 to the fabric covering the middle portion 120. The fabric material itself may provide the flexibility in the flexible connectors 142 and 152. Other ways of flexibly connecting portions 110–130 and overlapping panels 140 and 150 will be apparent to those skilled in the mechanical arts, such as hinges, locking hinges, and connecting via flexible ballistic material within the portions and panels.

Other features of the fabric covering may include different external colors for the shield, such as black, yellow, "camouflage" brown/green patterns, and so forth. Fabric may also be amenable to painting (or attaching hook and loop fasteners for) logos or word(s) on the front of shield 100. Such words may include, for example, "Police," "SWAT," "Safety Behind Me," and so on. A fabric covering (or portions thereof) may also be relatively easily replaced in the event of damage or excessive wear.

Figure 2:
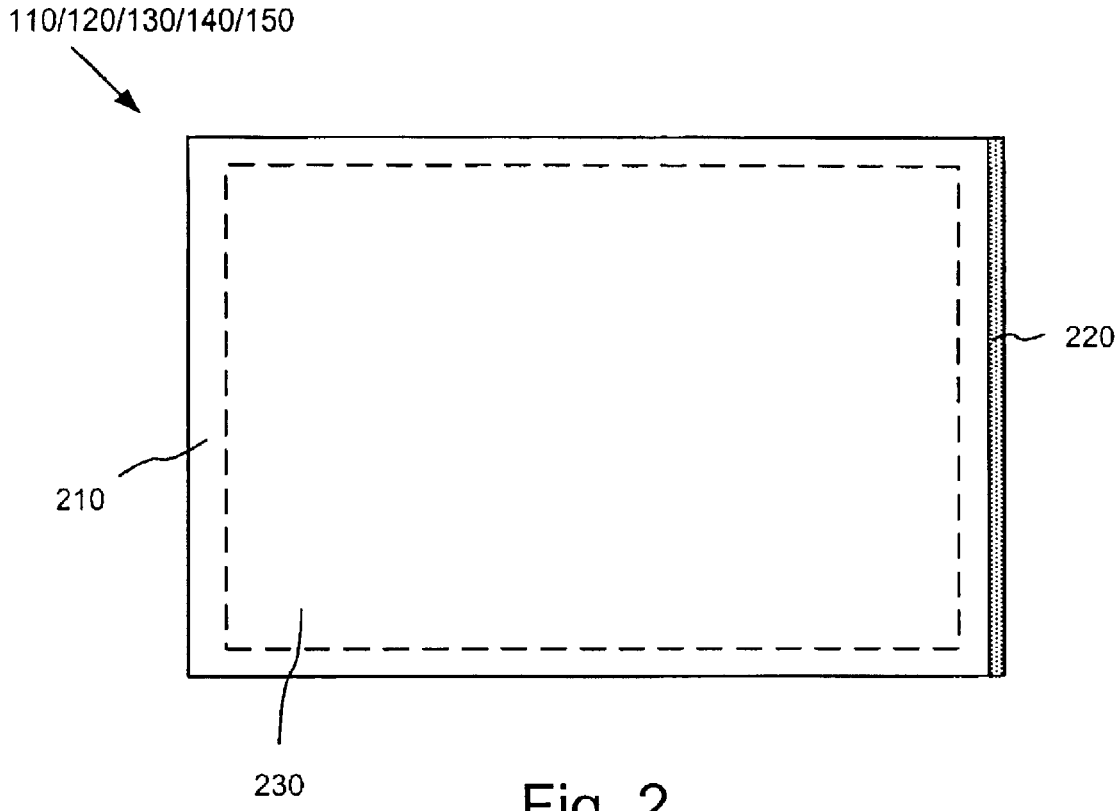
FIG. 2 is a diagram illustrating a front view of a portion of the ballistic shield of FIG. 1.

FIG. 2 is a diagram illustrating a front view of a portion of the ballistic shield 100. The portion shown may be structurally representative of any one of top portion 110, middle portion 120, bottom portion 130, top overlapping panel 140, and bottom overlapping panel 150. The portion 110/120/130/140/150 may include a covering material 210, a fastener 220, and a ballistic panel 230.

Covering material 210 may include a fabric, such as nylon or a ballistic fabric. Covering material 210 may be arranged in a bag-like or pocket configuration so that it has an interior space. In a typical configuration, all sides of the covering material 210 may be closed to prevent access to, or escape from, the interior space. Covering material 210 may completely enclose its interior space, with the possible exception of upper portion 110, in which covering material may contain front and rear openings for a transparent view port (e.g., 105 in FIG. 1).

At least one side of the covering material 210 may be reclosably fastened by fastener 220. It is possible that two or three sides of the covering material 210 may include fasteners 220. Examples of suitable fasteners 220 may include hook and loop fasteners, buttons, snaps, zippers, or similar reclosable fasteners. Fastener 220 may allow temporary access to the interior space in the covering material 210, but may close the interior space when fastened.

Ballistic panel 230 may be configured to fit within the interior space of the covering material 210. Ballistic panel 230 may be either flexible or rigid, depending on its materials and construction. Ballistic panel 230 may have a different shape and size, depending in which one of portions 110/120/130/140/150 it resides.

Figure 3:
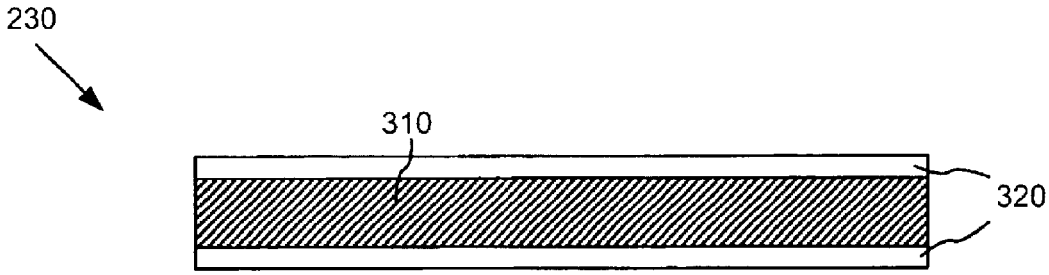
FIG. 3 is a diagram illustrating a side view of the ballistic panel of FIG. 2.

FIG. 3 is a diagram illustrating a side view of the ballistic panel 230. Ballistic panel 230 may include a ballistic material 310 and one or more stiffening members 320. In the implementation shown in FIG. 3, ballistic panel 230 may be made rigid through the use of two stiffening members 320 above and below the ballistic material 310. In other implementations where the ballistic panel 230 is not designed to be as rigid, however, one or both of the stiffening members 320 may be eliminated.

Ballistic material 310 may include one or more layers of woven ballistic fabric or a bi-directional composite ballistic structure. The ballistic material 310 may have been compressed during manufacture to provide more protection for a given cross-sectional width of material. Examples of possible ballistic materials include KEVLAR® brand ballistic material, SPECTRA® brand ballistic material, SPECTRA SHIELD® brand ballistic material, and other types of manufactured ballistic materials known to those skilled in the ballistic shield and armor arts. The ballistic material 310 may be made in different configurations (e.g., thicknesses, weights) to provide different levels of ballistic protection (e.g., National Institute of Justice (NIJ) ballistic threat level 3A and others).

Stiffening members 320 may be formed of a polymer material, such as plastic. Although stiffening members 320 may provide some additional ballistic protection over that provided by the ballistic material 310, they are primarily intended to provide structural rigidity to the ballistic panel 230.

Returning to FIG. 2, covering material 210 may attach the top, bottom, or top and bottom of the portion shown to other portions 110/120/130/140/150 as described with respect to FIG. 1.

Returning to FIG. 1, when fully assembled, shield 100 may give similar protection against projectiles to a conventional unitary ballistic shield. Shield 100 may be, in one implementation consistent with the principles of the invention, 24 inches wide by 48 inches high when fully extended. In this implementation, the window portion 105 may be 10 inches wide by two inches high. When folded into thirds, shield 100 may be 24 inches wide by 15 inches high. Other sizes are possible for shield 100.

Figure 4:
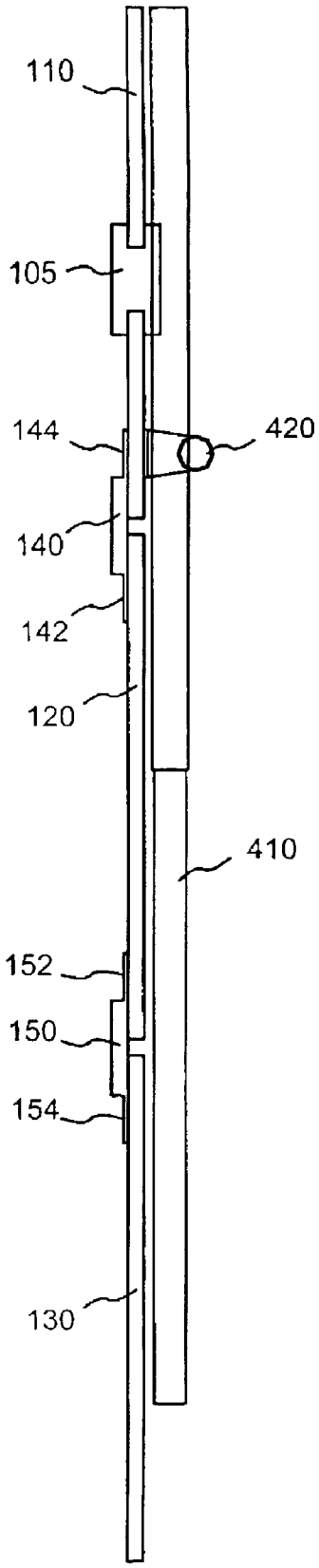
FIG. 4 is a diagram illustrating a side view of the exemplary ballistic shield of FIG. 1.

FIG. 4 is a diagram illustrating a side view of the exemplary ballistic shield 100 of FIG. 1. In addition to the elements 105–154 described with respect to FIG. 1, shield 100 when assembled may include one or more stiffening rods 410 and one or more handles 420.

Stiffening rod(s) 410 may be constructed of a light but rigid material, such as aluminum. Stiffening rods 410 may be collapsible (i.e., two or more pieces joinable into a single stiffening rod 410). It should be noted that stiffening rods 410 are but one possible implementation for providing structural support and rigidity to shield 100. In other implementations, the shield 100 may be made rigid via: pipes, tubes, sliding latches or similar hardware used to brace the portions 110–130 into one rigid unit. In still other implementations consistent with the principles of the invention, locking hinges or other types of hinges, possibly in conjunction with securing mechanisms, may be used to add rigidity to the shield 100. In another implementation, the shield 100 may remain somewhat flexible when fully deployed (even in implementations without the overlapping plates 140/150), and stiffening rod(s) 410 may not be needed.

One or more handles 420 may aid an operator in holding the shield 100. Handle 420 may be attached to the top portion 110 and/or the middle portion 120. In one implementation, one of handles 420 may be a rigid tube attached to one of portions 110/120. In another implementation, one of handles 420 may be non-rigid, fabric handles (not shown in FIG. 4) attached to the covering material 210. Handles 420 may be oriented in different directions (e.g., vertically, horizontally, diagonally, etc.) to allow a user flexibility in holding and orienting the shield 100.

Figure 5:
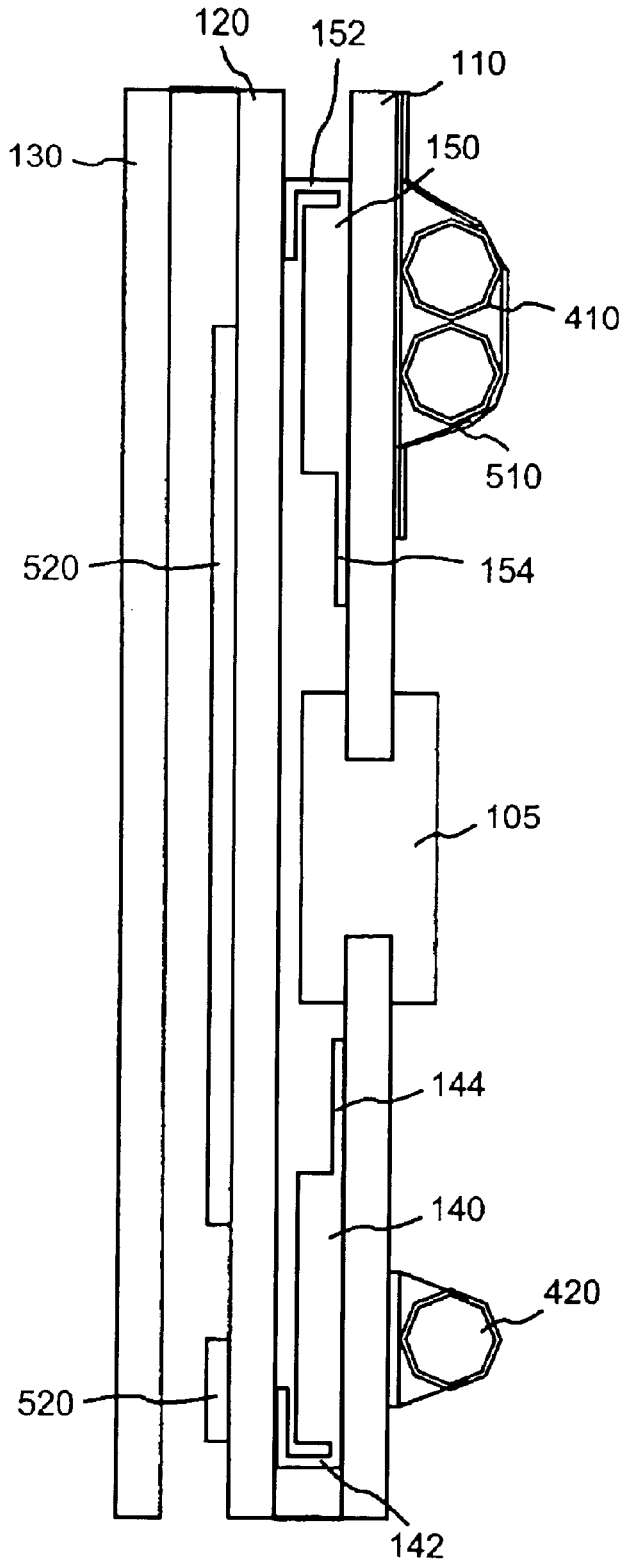
FIG. 5 is a diagram illustrating a collapsed side view of the exemplary ballistic shield of FIG. 1.

FIG. 5 is a diagram illustrating a side view of the exemplary ballistic shield 100 in a folded configuration. When folded, shield 100 may be roughly one third the height of the fully assembled shield 100. In other words, shield 100 may be folded to a compact size (i.e., the dimensions of one of portions 110/120/130) relative to its fully assembled dimensions. In this folded configuration, shield 100 may be stowed in a carrying case or bag (not shown), which may also make the shield 100 water resistant.

In addition to the elements described above with respect to FIGS. 1–4, shield 100 may include one or more retaining straps 510 and one or more flexible handles 520. Retaining straps 510 may be formed of a fabric or similar material, and may be used to store the pieces of stiffening rods 410 when not in use.

Flexible handles 520 may also be formed of a fabric or similar material, and may be used to hold the shield 100 similar to, or instead of, the rigid handle 420. As shown in FIG. 5, one or more flexible handles 520 may be oriented horizontally (i.e., across the width of shield 100), and one or more flexible handles 520 may be oriented vertically (i.e., along the length of shield 100). Such different orientations of handles 520 allow a user of the shield 100 to comfortably hold it in multiple positions.

Figure 6:
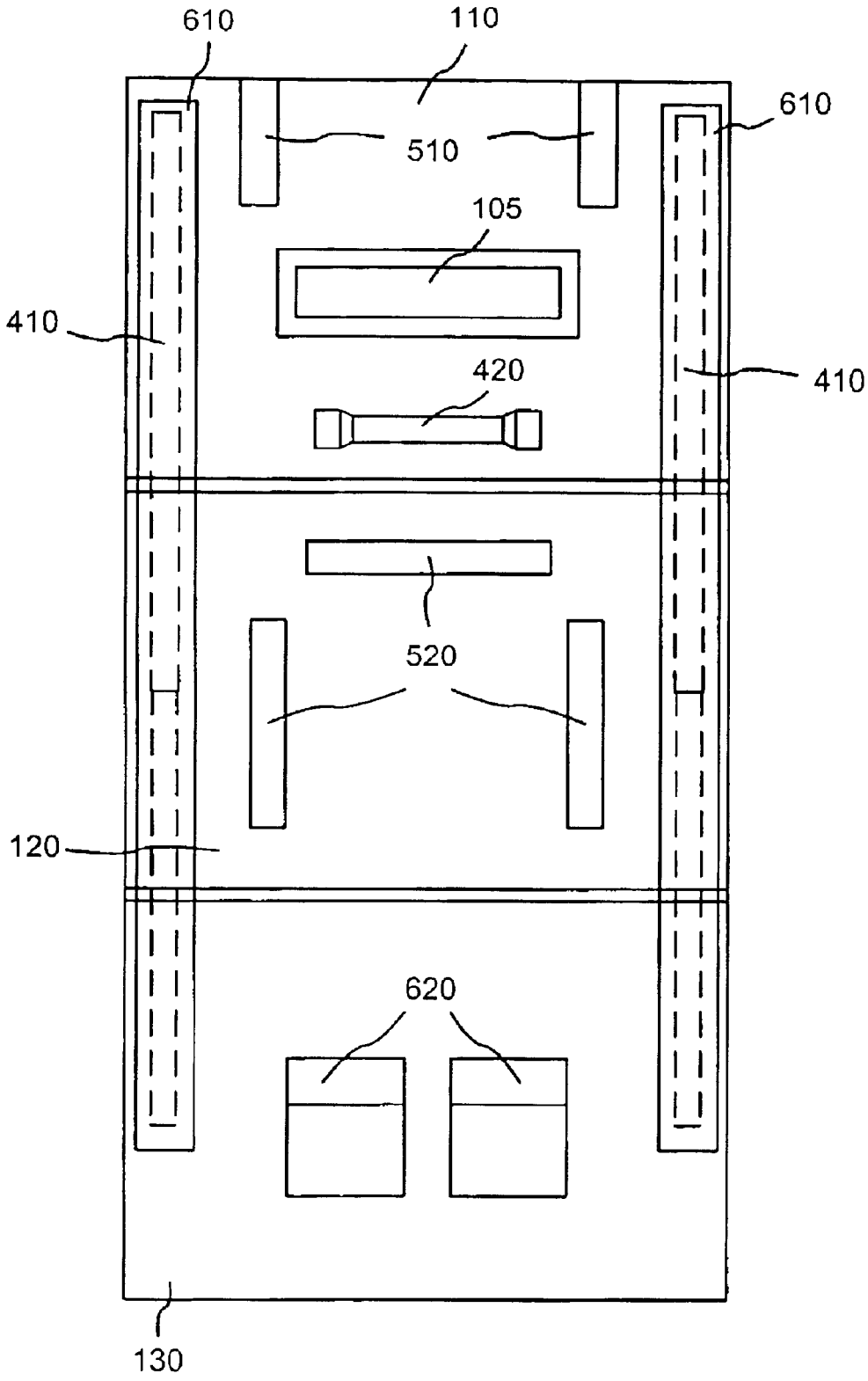
FIG. 6 is a diagram illustrating a rear view of the exemplary ballistic shield of FIG. 1.

FIG. 6 is a diagram illustrating a rear view of the exemplary ballistic shield 100. FIG. 6 provides an operator's view of the shield 100. In addition to the elements described above with respect to FIGS. 1–5, shield 100 may include one or more sheaths 610 and one or more pockets 620.

Sheaths 610 may be formed from material, such as fabric, and may be configured to retain stiffening rods 410. For example, sheaths 610 may be sewn or otherwise attached to the covering material 210 of portions 110–130, and stiffening rods 410 may be inserted and removed from the tops of sheaths 610. The tops of sheaths 610 may include reclosable fasteners, such as hook and loop fasteners, for retaining stiffening rods 410.

Pockets 620 may also be formed of fabric material, and may be attached to one or more of portions 110–130. The pockets 620 may include reclosable fasteners, such as hook and loop fasteners, for retaining items in the pockets. Such items may include pepper spray, ammunition, first aid materials, or any other articles that may typically be used in conjunction with shield 100.

Exemplary Two Portion Shield

Figure 7:
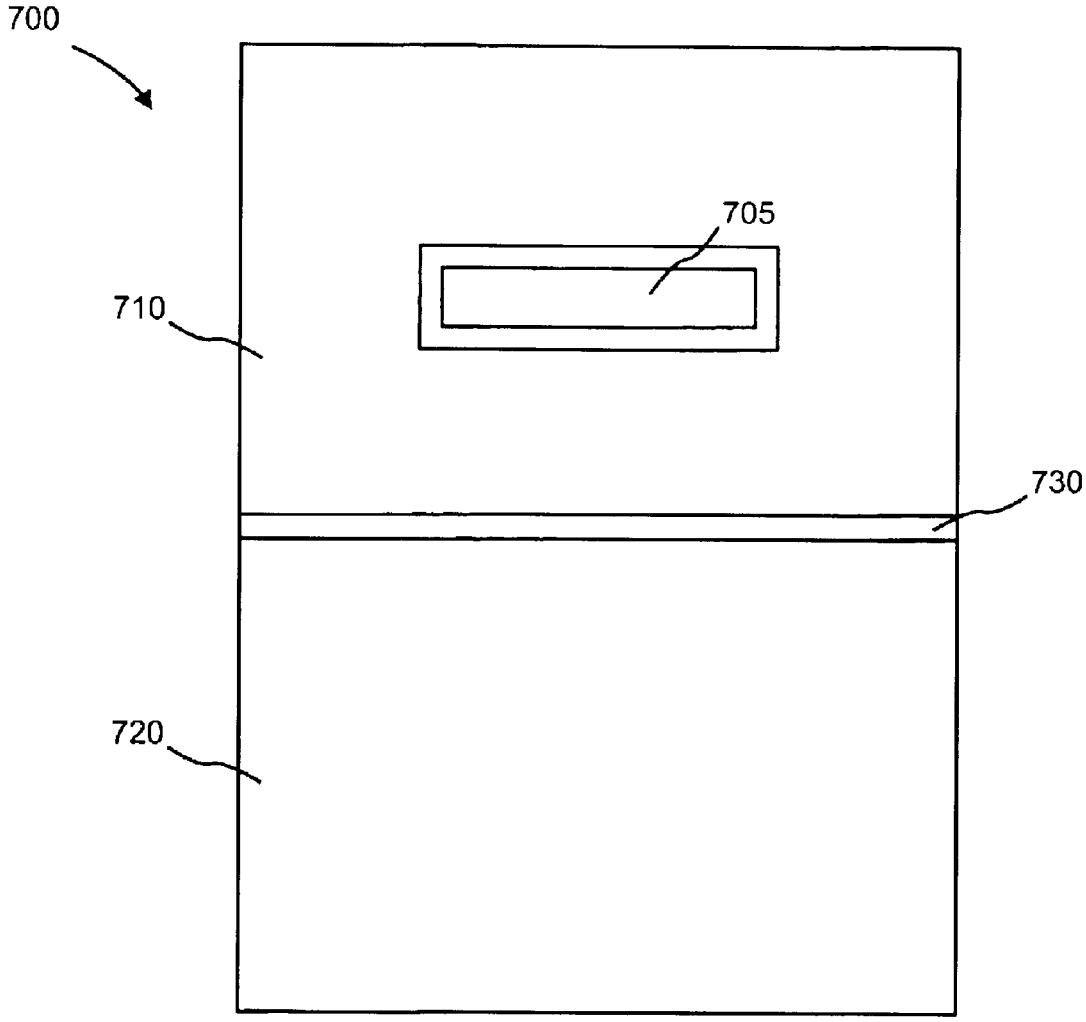
FIG. 7 is a diagram illustrating a front view of another exemplary ballistic shield according to another implementation consistent with the present invention.

FIG. 7 is a diagram illustrating a front view of an exemplary ballistic shield 700 according to another implementation consistent with the present invention. Shield 700 may include a top portion 710, a bottom portion 720, and a flexible connector 730. Top portion 110 portion 710 and bottom portion 720 may be flexibly connected by flexible connector 730 so that they may fold (e.g., in a "V" manner) to overlap one another.

Top portion 710 may include a window portion 705 that is similar in function and construction to the previously-described window portion 105. The remainder of top portion 710 may include a ballistic panel similar in function and construction to the previously-described ballistic panel 230. In one implementation consistent with the principles of the invention, top portion 710 may not include any covering, such as covering material 210. In such an implementation, the outer surface of top portion 710 may be the stiffening material of the ballistic panel (e.g., stiffening members 320). In another implementation consistent with the principles of the invention, however, the top portion 710 may include a covering, such as covering material 210.

Bottom portion 720 may include a ballistic panel similar in function and construction to the previously-described ballistic panel 230. As described above with respect to top portion 710, the bottom portion 720 may, or may not, be covered with a covering material (e.g., covering material 210) such as a fabric.

Flexible connector 730 may serve to flexibly connect top portion 710 and bottom portion 720. In one implementation consistent with the principles of the invention, flexible connector 730 may also serve to make shield 700 rigid when opened. In such an implementation, flexible connector 730 may include a locking hinge or similar device that tends to hold top portion 710 and bottom portion 720 in a planar orientation when the hinge is opened. In other implementations consistent with the principles of the invention, flexible connector 730 may not enhance the rigidity of shield, in which case stiffening rods (not shown) similar to rods 410 may be used.

In one implementation consistent with the principles of the invention, flexible connector 730 may include only a hinge or other flexible connector joining a separate top portion 710 and bottom portion 720. In such an implementation, top portion 710 and bottom portion 720 may closely abut to minimize any gap between them. Alternately, top portion 710 and bottom portion 720 may have an adjoining structure (e.g., complementary tongue and groove) so that no gap exists between the portions. The tongue (i.e., the material that extends into the opposite portion) in such a configuration may be made of ballistic material 310.

In another implementation consistent with the principles of the invention, flexible connector 730 may be formed of ballistic material 310. In such an implementation, the ballistic material 310 may be a continuous sheet from top portion 710 to bottom portion 720. The stiffening members 320 may be removed in the region corresponding to flexible connector 730. Hence, the ballistic material 310 between top portion 710 and bottom portion 720 may connect these portions and flex sufficiently to permit shield 700 to fold.

In still another implementation, flexible connector 730 may be a covering material (e.g., covering material 210) such as a fabric. Such an implementation may include an overlapping panel, such as overlapping panel 140/150 (not shown), to cover any gap between top portion 710 and bottom portion 720.

When fully assembled, shield 700 may give similar protection against projectiles to a conventional unitary ballistic shield. Shield 700 may be, in one implementation consistent with the principles of the invention, 19 inches wide by 34 inches high when fully extended. In this implementation, the window portion 105 may be about 10 inches wide by two inches high, or slightly smaller. When folded in half, shield 700 may be 19 inches wide by about 16 inches high. Other sizes are possible for the two-portion shield 700. For example, the width of the shield 700 may vary from about 15 inches to about 30 inches, and the height of the fully extended shield may vary from about 30 inches to about 55 inches long. The height of the folded shield may depend on its extended/overall length and the number of folding portions (e.g., 2, 3, 4, etc.).

Figure 8:
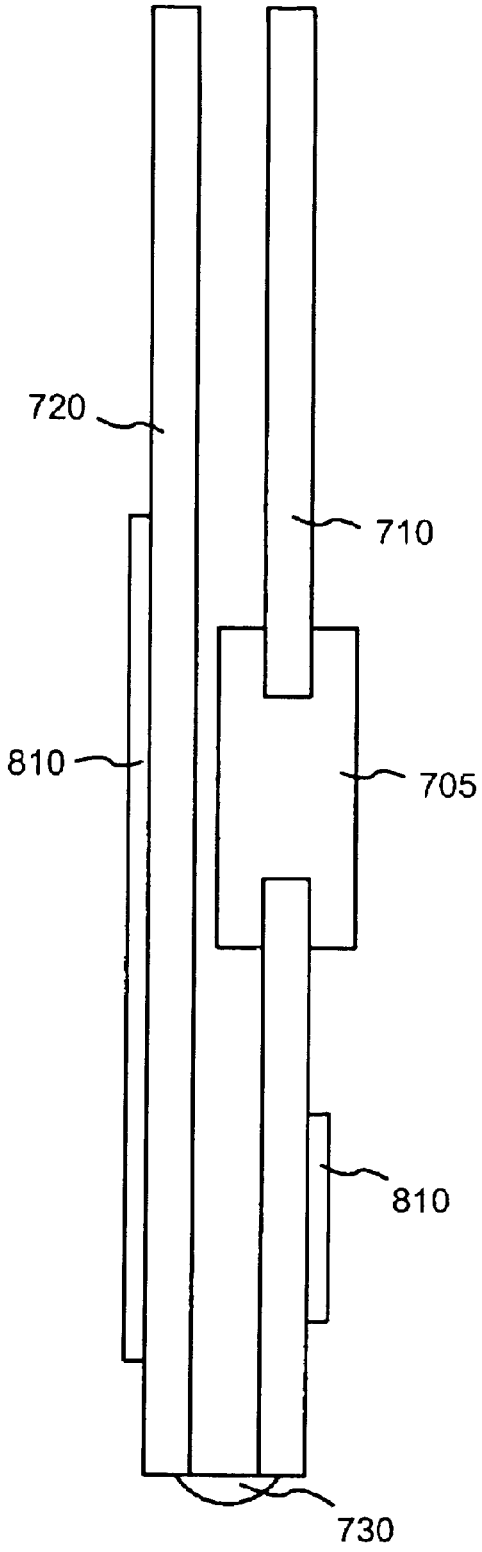
FIG. 8 is a diagram illustrating a collapsed side view of the exemplary ballistic shield of FIG. 7.

FIG. 8 is a diagram illustrating a side view of the exemplary ballistic shield 700 in a folded configuration. When folded, shield 700 may be roughly one half the height of the fully assembled shield 700. In other words, shield 700 may be folded to a compact size (i.e., the dimensions of one of portions 710/720) relative to its fully assembled dimensions. In this folded configuration, shield 700 may be stowed in a carrying case or bag (not shown), which may also make the stowed shield 700 water resistant.

In addition to the elements described above with respect to FIG. 7, shield 700 may include one or more handles 810. Handles 810 may be formed of a fabric, plastic, or similar material, and may be used to hold the shield 700. As shown in FIG. 8, one or more handles 810 may be oriented horizontally (i.e., across the width of shield 700), and one or more handles 810 may be oriented vertically (i.e., along the length of shield 700). Such different orientations of handles 810 allow a user of the shield 700 to comfortably hold it in multiple positions. Handles 810 may be attached to portions 710 and/or 720 of shield 700 by stitches, rivets, screws, or other suitable fasteners.

Exemplary Shield Assembly

Several acts may be performed to assemble the shield 100/700 from a collapsed state to an extended state. The shield 100/700 may be removed from any case in which it is stored. The shield 100/700 may be unfolded, or otherwise fully extended. The overlapping panels 140/150 (perhaps embodied as flaps attachable on one side by hook and loop fasteners) may be closed to overlap scams between the portions 110/120/130 or 710/720.

In one implementation, at least one of the overlapping panels (e.g., panel 140) may be rotated into place by a cable or strap (not shown) attached to a front side of the panel. As the shield 100/700 is allowed to fall open in a downward direction, the cable/strap may rotate one or more of the overlapping panels upward into place, where they are attached by, for example, hook and loop fasteners. Other overlapping panels may rotate downward into place by the force of gravity. In such a manner, the overlapping panels 140/150 may be rapidly deployed.

The stiffening rods 410, if used, may be assembled from two or more portions per rod. The rods 410 may be inserted into sheaths 610 to stiffen the shield 100/700. Shield 100/700 may be deployed in less than a minute, even when performing all possible assembly acts. As noted above, several of the acts (e.g., pulling from the case and connecting/inserting stiffening rods 410) may be unnecessary. Thus, implementations of the shields described herein may facilitate a rapid response to an emergency situation by first responders.

CONCLUSION

Consistent with the principles of the present invention, a ballistic shield may include a number of foldably connected ballistic plates that may be extended to form an integral shield. Overlapping ballistic sections may be affixed to cover seams or gaps between adjacent ones of the connected plates.

The foregoing description of embodiments of the present invention provides illustration and description, but is not intended to be exhaustive or to limit the invention to the precise form disclosed. Modifications and variations are possible in light of the above teachings or may be acquired from practice of the invention.

Other implementations are possible and contemplated. For example, overlapping panels 140/150 may separate pieces from the shield 100 (e.g., both of connectors 142 and 144 may be removable connectors, such as hook and loop connectors). Further, although two and three shield portions (i.e., 710/720 and 110/120/130) have been shown, more portions may be used. Similarly, one or more shield handles may be used. Also, fewer or more than two stiffening rods 410 may be used.

Further, although portions 110/120/130 are shown as being rectangular in shape, other shapes are possible for certain portions (e.g., triangular, trapezoidal, hexagonal, irregularly shaped). Also, although ballistic panels 230 have been described as rigid, stiffening members 320 may be removed to allow, for example, rolling up of the shield 100/700 into a roll or bundle. Moreover, shield 100/700 may include one or more side portions (not shown) that provide some side protection. These side portions may fold inward to overlap the shield 100/700 at their attachment points, and may also include gaps mirroring the horizontal gaps in shield 100/700.

Shield 100/700 should not be seen as limited to the exemplary implementations shown in FIGS. 1–8. Shield 100/700 may be manufactured with or without a ballistic view port. Shield 100/700 may be manufactured with or without overlapping panels to cover seams between folding portions. Shield 100/700 may be manufactured with or without stiffening rods 410 or other stiffening devices such as locking devices. Shield 100/700 may be manufactured with or without fabric covering material. Various variations and combinations of features will be understood by those skilled in the ballistic shield art upon reading the description herein.

No element, act, or instruction used in the description of the present application should be construed as critical or essential to the invention unless explicitly described as such. Also, as used herein, the article "a" is intended to include one or more items. Where only one item is intended, the term "one" or similar language is used. The scope of the invention is defined by the claims and their equivalents.

What is claimed:

1. A ballistic shield, comprising:

a first ballistic plate including a ballistic material;

a second ballistic plate including the ballistic material and connected to a side of the first ballistic plate so that the first ballistic plate and the second ballistic plate may fold together to substantially overlap and so that a gap exists between the first ballistic plate and the second ballistic plate when not folded together;

a fabric covering the first ballistic plate and the second ballistic plate, the fabric connecting the first ballistic plate and the second ballistic plate and providing the gap between the first ballistic plate and the second ballistic plate;

an overlapping ballistic section including the ballistic material and connected to at least one of the first ballistic plate and the second ballistic plate so that the overlapping ballistic section covers the gap between the first ballistic plate and the second ballistic plate; and a handle to facilitate holding of the ballistic shield.

2. The ballistic shield of claim 1, wherein each of the first ballistic plate, the second ballistic plate, and the overlapping ballistic section includes at least one stiffening member connected to the ballistic material.

3. The ballistic shield of claim 1, wherein the fabric includes at least one reclosable fastener to facilitate insertion and removal of at least one of the first ballistic plate and the second ballistic plate.

4. The ballistic shield of claim 1, wherein the fabric covers the overlapping ballistic section and connects the overlapping ballistic section to the at least one of the first ballistic plate and the second ballistic plate.

5. The ballistic shield of claim 4, wherein the overlapping ballistic section includes a fastener configured to connect the overlapping ballistic section to another of the first ballistic plate and the second ballistic plate.

6. The ballistic shield of claim 1, further comprising:

a rotating connector connecting the first ballistic plate and the second ballistic plate.

7. The ballistic shield of claim 6, wherein the rotating connector is configured to lock the first ballistic plate and the second ballistic plate in a coplanar orientation.

8. The ballistic shield of claim 1, wherein the first ballistic plate includes:

a ballistic window including another ballistic material.

9. The ballistic shield of claim 1, further comprising:

a third ballistic plate including the ballistic material and connected to a side of the second ballistic plate so that the third ballistic plate and the second ballistic plate may fold together to substantially overlap and so that a gap exists between the third ballistic plate and the second ballistic plate when not folded together; and a second overlapping ballistic section including the ballistic material and connected to one of the third ballistic plate and the second ballistic plate so that the second overlapping ballistic section may cover the gap between the third ballistic plate and the second ballistic plate.

10. The ballistic shield of claim 1, wherein a width of the ballistic shield is in a range from about 15 inches to about 30 inches, and a length of the ballistic shield when fully extended is in a range from about 30 inches to about 55 inches.

11. A foldable ballistic shield, comprising:

a plurality of foldably connected ballistic portions, each of the ballistic portions including a panel of ballistic material;

at least one overlapping ballistic section moveably connected to at least one of the plurality of foldably connected ballistic portions to overlap at least one seam between adjacent ones of the plurality of foldably connected ballistic portions, each of the at least one overlapping ballistic sections including a section of ballistic material;

a covering material enclosing the plurality of foldably connected ballistic portions and the at least one overlapping ballistic section; and a handle that facilitates holding of the foldable ballistic shield.

12. The ballistic shield of claim 11, further comprising:

at least one stiffening rod connectable to the plurality of foldably connected ballistic portions to provide rigidity to the ballistic shield.

13. The ballistic shield of claim 11, wherein the covering material is arranged to foldably connect the plurality of foldably connected ballistic portions.

14. The ballistic shield of claim 11, wherein one of the plurality of foldably connected ballistic portions includes a transparent view port.

15. The ballistic shield of claim 11, wherein the plurality of foldably connected ballistic portions includes:

a first ballistic portion, a second ballistic portion foldably connected to the first ballistic portion, and a third ballistic portion foldably connected to the second ballistic portion; and wherein the at least one overlapping ballistic section includes:

a first overlapping ballistic section moveably connected to one of the first ballistic portion and the second ballistic portion, and a second overlapping ballistic section moveably connected to one of the second ballistic portion and the third ballistic portion.

16. A ballistic shield, comprising:

a first ballistic plate including a ballistic material;

a second ballistic plate including the ballistic material and connected to a side of the first ballistic plate so that the first ballistic plate and the second ballistic plate may fold together to substantially overlap, where a gap exists between the first ballistic plate and the second ballistic plate when in a coplanar orientation;

a fabric covering the first ballistic plate and the second ballistic plate, the fabric connecting the first ballistic plate and the second ballistic plate, where the fabric spans the gap between the first ballistic plate and the second ballistic plate; and a third ballistic plate including the ballistic material and connected to the first ballistic plate to cover the gap between the first ballistic plate and the second ballistic plate.

* * * * *